US008322915B2

(12) United States Patent
Wong

(10) Patent No.: US 8,322,915 B2
(45) Date of Patent: Dec. 4, 2012

(54) COMPENSATION ADJUSTMENT DEVICE FOR MECHANICAL TIMEPIECE

(76) Inventor: Chit Yin Wong, Kwai Chung (HK)

( * ) Notice: Subject to any disclaimer, the term of this patent is extended or adjusted under 35 U.S.C. 154(b) by 223 days.

(21) Appl. No.: 12/905,437

(22) Filed: Oct. 15, 2010

(65) Prior Publication Data

US 2011/0090769 A1 Apr. 21, 2011

(30) Foreign Application Priority Data

Oct. 16, 2009 (HK) ..... 09109599.7

(51) Int. Cl.
*G04B 18/00* (2006.01)

(52) U.S. Cl. ..... 368/186

(58) Field of Classification Search ..... 368/186, 368/185, 184, 137, 181, 200, 216, 147, 202, 368/319–321, 308
See application file for complete search history.

(56) References Cited

U.S. PATENT DOCUMENTS 1,835,391 A * 12/1931 Haefliger ..... 368/170
2,852,909 A * 9/1958 McKie et al. ..... 368/175
3,540,210 A * 11/1970 Toshiaki et al. ..... 368/173
3,736,743 A * 6/1973 Koike ..... 368/200

FOREIGN PATENT DOCUMENTS

WO WO0148566 A1 7/2001

* cited by examiner

*Primary Examiner* — Edwin A. Leon
(74) *Attorney, Agent, or Firm* — Fraser Clemens Martin & Miller LLC; J. Douglas Miller

(57) ABSTRACT

A compensation adjustment mechanism for a mechanical timepiece is provided including a gear set and a crown. A first gear at the input end of the gear set is connected to the crown, a second gear at the output end of the gear set is connected to a regulator pin on a balance spring, and a chapter ring is connected to the gear set and capable of rotating together with the crown. Adjustment of the regulator pin is performed by rotating the crown and is visible on the chapter ring. The scale on the chapter ring is predetermined according to the characteristics of the balance spring.

10 Claims, 4 Drawing Sheets

COMPENSATION ADJUSTMENT DEVICE FOR MECHANICAL TIMEPIECE

CROSS-REFERENCE TO RELATED APPLICATION

This application claims the benefit of Hong Kong Application No. 09109599.7 filed Oct. 16, 2009, hereby incorporated herein by reference in its entirety.

TECHNICAL FIELD

This invention relates to a mechanical timepiece, and more particularly, relates to a compensation adjustment device for a mechanical timepiece.

BACKGROUND OF THE INVENTION

Mechanical timepiece finds favor especially in the upper class because of the delicate workmanship and accurate structure. Relying on the metallic movement therein, a mechanical timepiece usually can be used for quite a long time. Therefore, high-grade mechanical timepiece also has its collection value. However, it is commonly known that a mechanical timepiece may not be able to provide sufficiently precise timekeeping. People have been seeking methods for improving its precision for a long time.

Accurate and reliable timekeeping is a basic requirement for all types of timepieces. Particularly, for a timepiece using a mechanical movement, factors such as the structural design, material selection, processing technology, and assembling quality will possibly affect the accuracy. As a result, the stability of the mainspring torque, the smooth operation of the transmission system and the accuracy of the escapement regulator may vary in different timepieces. Among all the factors, parameters of the balance spring, for example the width, thickness, turns and working length affect the timekeeping most directly. With the development of the modern technology, the precision of a mechanical timepiece has been greatly improved. The acceptable error certified by Swiss Astronomical Observatory is −4 to +6 seconds per day, namely −2 to +3 minutes per month. The error of an ordinary mechanical timepiece is about 3 to 10 minutes per month. For those asking for high accuracy timekeeping, however, such error is unacceptable.

Mechanical watches have much more complicated structures compared with electronic watches and quartz watches. Hence, once an error of timekeeping occurs, a common user can hardly adjust the watch himself. However, bring it back to the manufacturer or delivering it to a professional technician will waste a lot of time and will also render high service costs.

In addition to the internal structure of the timepiece, the environmental conditions and the user's custom also have influences on the timekeeping of the mechanical timepiece. For example, temperature change will induce change of performance of the lubricating oil and balance spring. The magnetic field of the environment, when greater than 60 Oersted, will cause magnetization of certain components within the timepiece. Also, high humidity will cause oxidization and erosion of the components. Therefore, even after maintenance, it is also possible for the watch to produce a greater error. Frequent returning to the manufacturer for maintenance is obviously undesirable.

The international patent application WO01/48566 has disclosed a mechanical timepiece with a regulator pin operating mechanism. The mechanical timepiece of WO01/48566 comprises a time calculating unit for calculating time having a quartz oscillator forming an oscillation source; an IC circuit including a frequency dividing unit for inputting output signal from the oscillation of the quartz oscillator and for outputting a signal corresponding to time by frequency division of the signal, and an energy source for operating the IC circuit; a daily rate detection unit for detecting the daily rate of the mechanical timepiece; and a daily rate adjusting portion including a regulator pin, operating on the basis of the count signal calculated by the time calculating unit and operating state signal representing the daily rate detected by the daily rate detection unit. By rotating the regulator pin on the basis of the operating state signal in this manner, the oscillation cycle of the balance wheel is changed such that it is possible to precisely adjust the daily rate of the mechanical timepiece. It can be seen that the device of WO01/48566 has a complicated structure and the cost thereof is therefore high. Besides, WO01/48566 employs a quartz oscillator, which inevitably brings about the defects with a quartz watch, for example the lifespan of the cell is limited.

SUMMARY OF THE INVENTION

In order to overcome the aforesaid problems existing in the present mechanical timepiece, a compensation adjustment device for any mechanical timepiece is introduced. One object of the invention is to provide a simple adjustment device, which is convenient to use and does not incur any extra cost. Besides, the mechanical timepiece can be adjusted without the necessity of disassembling it. Another object of this invention is to provide a visible adjustment device, such that the user can adjust the timepiece more precisely.

On one aspect, the invention provides a compensation adjustment device for a mechanical timepiece, comprising a gear set and a crown, wherein a first gear at the input end of the gear set being connected to the crown, and a second gear at the output end of the gear set being linked with a regulator pin connected to a balance spring, such that the position of the regulator pin can be adjusted by rotating the crown.

In one embodiment, the regulator pin is provided with a rack, the rack engages with the second gear such that the rotation of the second gear drives the movement of the rack which in turn adjusts the regulator pin.

In one embodiment, the regulator pin is fixedly connected to a gear coaxial with a shaft for holding hands of the timepiece. The coaxial gear engages with the second gear.

In one embodiment, the gear set is configured to magnify the movement of the regulator pin by 20 times or 40 times.

In one embodiment, the compensation adjustment device further comprises a chapter ring inside or outside the timepiece surface. The chapter ring is connected to the gear set via an additional gear set such that the chapter ring rotates with the crown.

Preferably, the scale on the chapter ring is predetermined according to the characteristics of the balance spring. The scale on the chapter ring can be uniformly or non-uniformly spaced.

In one embodiment, the compensation adjustment device further comprises a clutch between the first gear and the crown.

On another aspect, this invention provides a mechanical timepiece having the abovementioned compensation adjustment mechanism.

The compensation adjustment mechanism according to the present invention connects the adjusting action of the crown with the regulator pin within the timepiece by using a gear set. The very precise action needed to adjust the regulator pin is thereby magnified and transmitted to the crown. At the same time, visual indication is provided for the user. Therefore, the invention can achieve, but is not limited to, the following technical effects: to enable the user to easily and directly make adjustment to the timepiece according to the actual error; and to provide the user with individualized precise adjustment, such that he can freely adjust the timepiece according to his own conditions.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DETAILED DESCRIPTION OF THE PREFERRED EMBODIMENT

The following detailed description and appended drawings describe and illustrate various exemplary embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

A mechanical timepiece generally comprises a prime system (mainspring), a transmission system, an escapement regulator, hands and a winding system. The escapement regulator consists of an escapement and a vibration system which enables the escapement to maintain a regular movement by the periodical vibration of the balance spring, thereby maintaining precise timekeeping.

Figure 1:
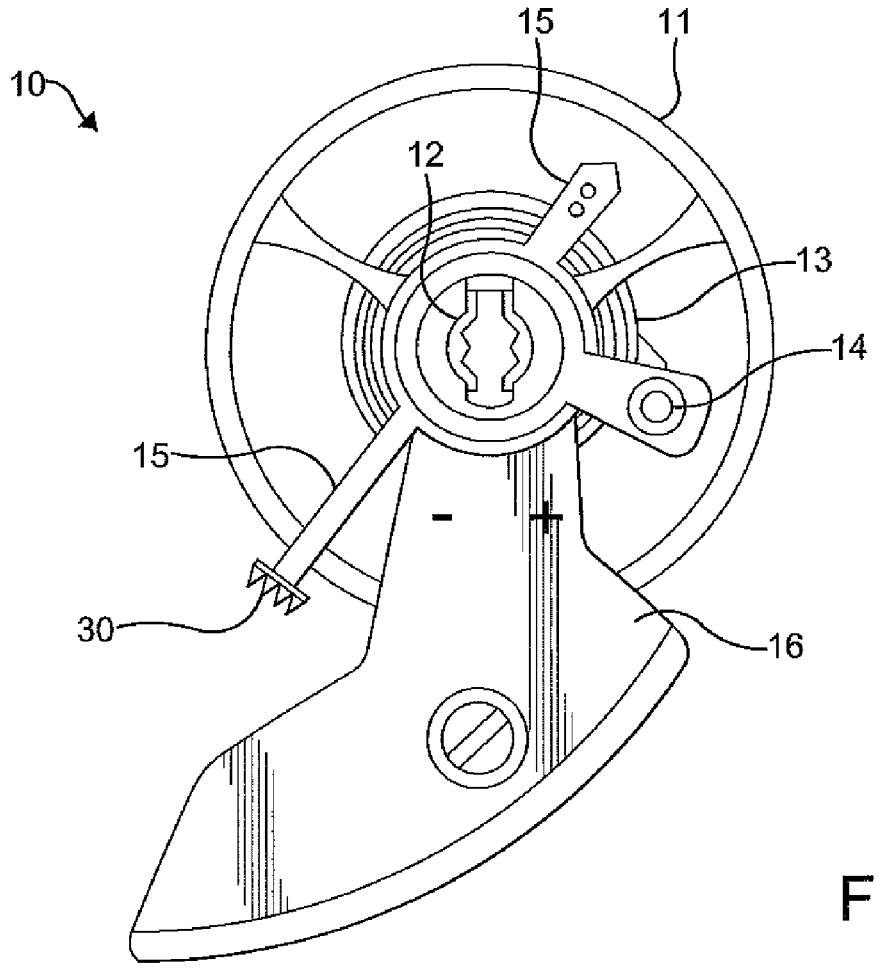
FIG. 1 shows the vibration system in a mechanical timepiece.

FIG. 1 shows the structure of a vibration system in a mechanical timepiece. The vibration system 10 consists of a balance wheel 11, a balance shaft 12, a balance spring 13, a movable anchor ear 14, a regulator pin 15 and a balance cock 16. The inner and outer ends of the balance spring 13 are respectively fixed onto the balance shaft 12 and the balance cock 16. When the balance wheel 11 deviates from its balance position under an external force and starts swinging, the balance spring 13 is twisted to produce potential energy, generally called a restoring torque. The escapement is used to transmit the energy of the prime system to the vibration system 10 to accomplish the first half of the vibration period. Then the vibration system 10 swings reversely under the action of the potential energy stored in the balance spring 13 to finish the second half of vibration period, thereby achieving one complete cycle during operation of the mechanical timepiece.

The regulator pin 15 is commonly used to adjust the timekeeping of a timepiece. When the working length (or vibration length) of the balance spring 13 is reduced, the vibration period will be shortened which causes the timepiece to run fast. On the contrary, the timepiece will run slow if the vibration period is increased. Since the regulator pin 15 of the timepiece is fixed on the balance spring 13, the working length of the balance spring 13 can be changed by adjusting the position of the regulator pin 15. In operation, the position of the regulator pin 15 is adjusted after opening the cover of the timepiece and disassembling the outer components such as the transmission gears. However, this could be difficult for a common user.

Figure 2:
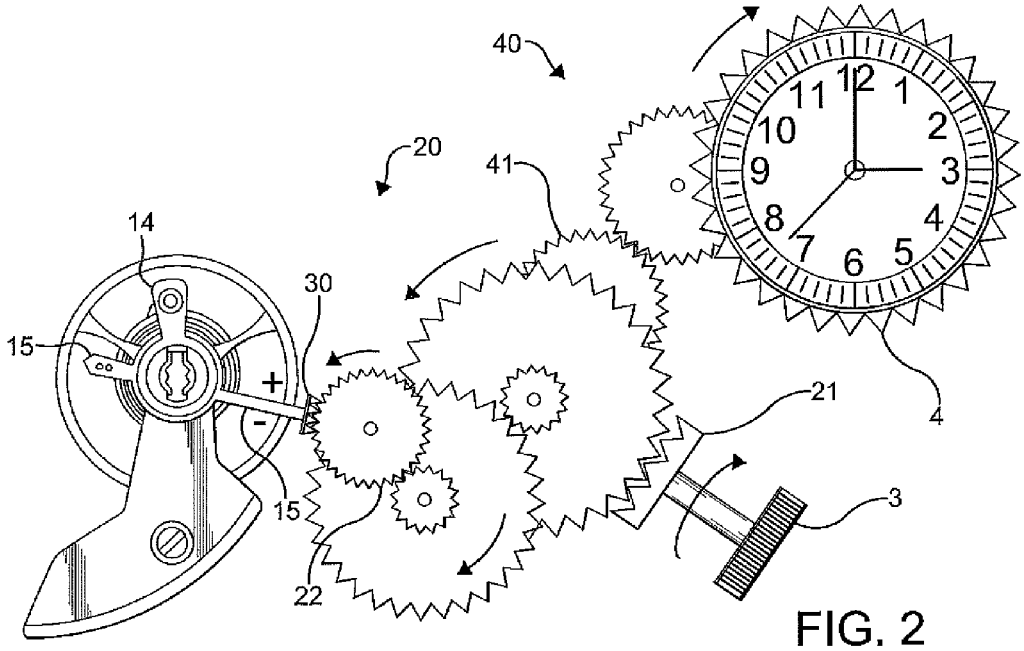
FIG. 2 shows the compensation adjustment device according to the present invention.

FIG. 2 shows the compensation adjustment device for a mechanical timepiece according to the present invention, comprising a gear set 20, a crown 3. A gear 21 at the input end of the gear set 20 is connected to the crown 3. A gear 22 at the output end of the gear set is configured to link the regulator pin 15 which connects to the balance spring 13. In one embodiment, a rack 30 is provided on the moving track of the regulator pin 15. The rack 30 engages with the output gear 22 of the gear set 20, thereby being driven by the rotation of the gear 22 to achieve the object of adjusting the regulator pin 15.

Due to the action of the gear set 20, the slight movement of the regulator pin 15 towards "+" or "−" direction is appropriately magnified, for example 20 times or 40 times, and is transmitted to the crown 3. Reversely, the adjustment implemented by rotating the crown 3 is transmitted to the rack 30 which limits the movement of the regulator pin 15, thereby causing the regulator pin 15 to move a tiny distance and finally affecting the working length of the balance spring 13.

The timepiece in the embodiment is also provided with a chapter ring 4 located inside or outside thereof. The chapter ring 4 can be connected to the gear set 20 via an additional gear set 40. It is understood that the additional gear set 40 may comprise at least one transmission gear. In the embodiment shown in FIG. 2, a gear 41 of the additional gear set 40 is set to connect a certain gear (not shown) of the gear set 20, such that the chapter ring 4 rotates with the movement of the regulator pin 15. At the same time, the rotation angle of the chapter ring 4 is also corresponding to the movement distance of the regulator pin 15. Therefore, the chapter ring 4 not only enables the user to get the actual degree of adjustment visually, but also provides a reference for later adjustments. The present invention can also be used without the chapter ring. For example, the user can record the angle or turns of rotating as a reference for later adjustments of the timepiece.

In the embodiment as shown in FIG. 2, the rack 30 is provided at the end of the regulator pin 15 to engage with the gear 22, such that the gear 22 drives the regulator pin 15 to adjust the actual working length of the balance spring 13. It should be noted that other configurations used to transfer the rotation of the crown 3 to the regulator pin 15 are also within the scope of the present invention. For example, the regulator pin 15 can be fixedly connected to a gear coaxial with a shaft for holding hands of the watch. The coaxial gear engages with the output gear 22 of the gear set 20 such that the regulator pin 15 can be adjusted by the gear set 20.

Figure 3:
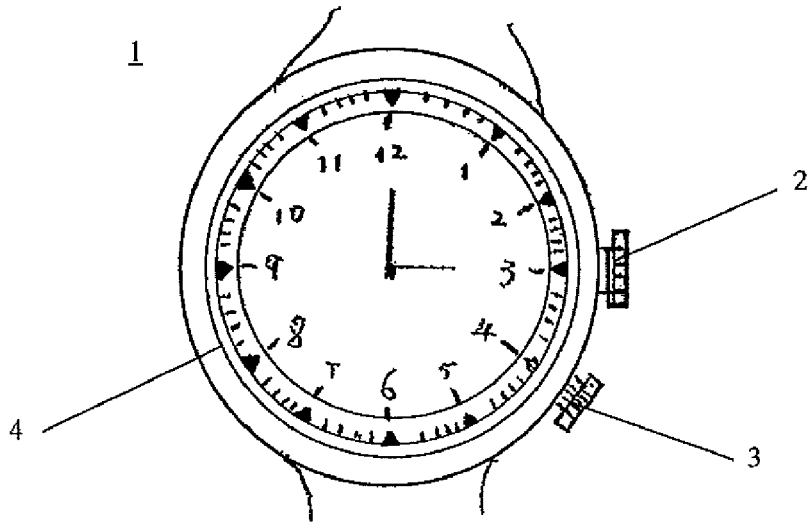
FIG. 3 shows a mechanical timepiece comprising a chapter ring according to the present invention.

FIG. 3 shows a timepiece 1 having a compensation adjustment device according to the present invention. The crown 3 is provided specially for adjusting the timekeeping of the timepiece in addition to a common crown 2. The crown 3 in FIG. 3 is located below the common crown 2. However, it is understood that the crown 3 can be provided at any position. Furthermore, the chapter ring 4 is also provided on the dial plate.

Although the crown 3 in FIG. 3 is located outside of the watch case, it can also be embedded within the case and being adjustable by tools. That is to say, the crown 3 in the present invention refers to a crown adjustable by a user (possibly by tools) without the necessity of disassembling the timepiece.

Figure 4:
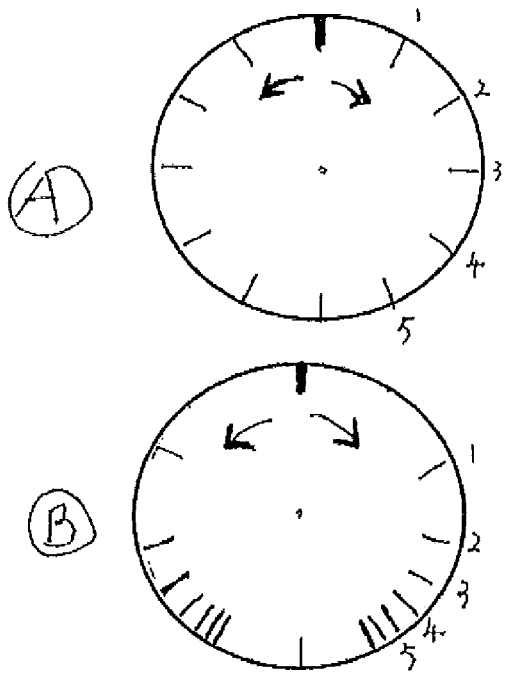
FIGS. 4A and 4B show uniform and non-uniform scales on a chapter ring.

As shown in FIGS. 3 and 4A, the scale on the chapter ring 4 is uniformly spaced. Considering the error range of an ordinary mechanical timepiece, one turn of the chapter ring 4 is preferably set to correspond to twelve minutes, i.e. one big scale corresponds to one minute. The scale can also be non-uniformly spaced as shown in FIG. 4B. In such occasion, the spacing of the scale on the chapter ring is determined with reference to the non-linear characteristic of the balance spring 13. FIGS. 4A-4B only show two examples of the arrangement of the chapter ring 4. It is understood to those skilled in the art that other designs of the chapter ring 4 can be used as long as they conform to the characteristic of the balance spring 13. The chapter ring 4 may also be provided with marks, for example numbers, for identification.

Figure 5:
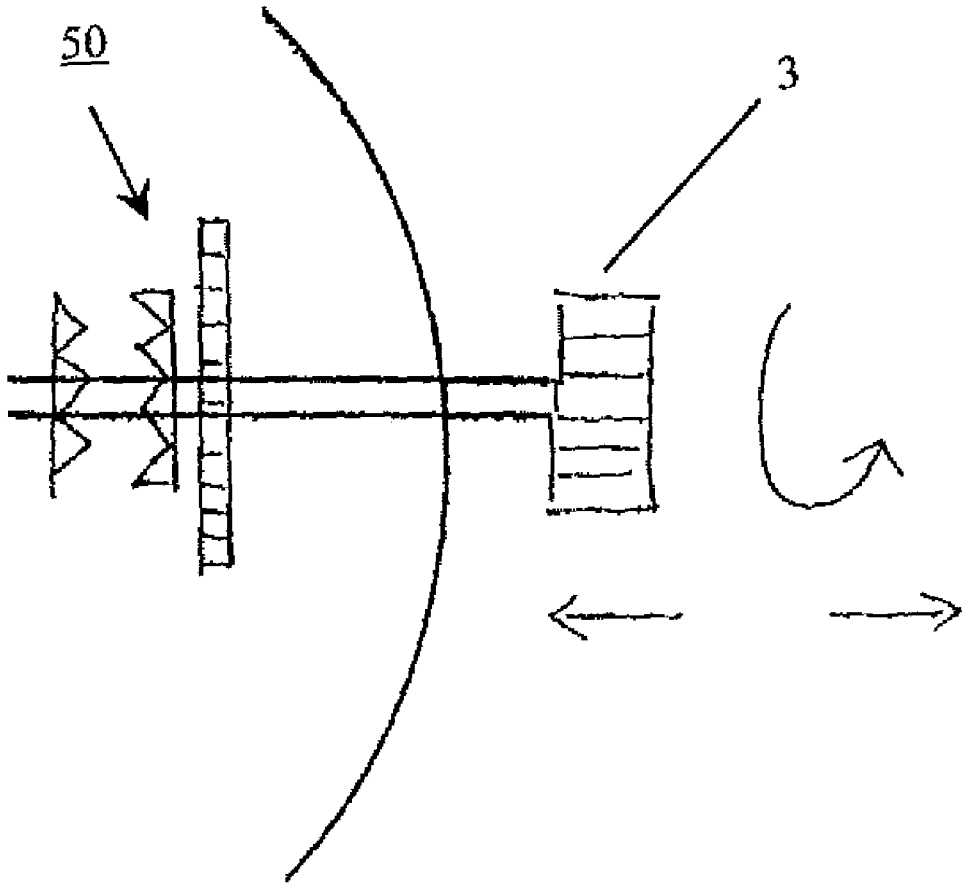
FIG. 5 shows a clutch disposed between the gear set and the crown.

As shown in FIG. 5, a clutch 50 can be provided between the gear and the crown 3. When the crown 3 is pulled out, the gears engage with one another. When the crown is pushed in, the gears separate from one another. In this way, even if the crown 3 is accidentally touched by the user, it will not cause the regulator pin 15 within the timepiece to move. Therefore, undesired adjustments can be avoided.

The adjustment method of a mechanical timepiece with a compensation adjustment device is described hereafter. Firstly, the user sets the timepiece to the standard time based on the broadcasting time by rotating the common crown of the watch. After one month the timing of the watch is checked again. For example it is found that the watch is five minutes fast.

At this moment, the user rotates the crown 3 for adjustment of the regulator pin 15 after restoring the watch to standard time. Since the watch is provided with the chapter ring 4, the user easily knows the degree of adjustment according to the angle of rotation. In this example, the watch is five minutes fast. So the user rotates the crown 3 toward "–" direction by 5 big scales to complete the first adjustment.

Then, the user continues using the timepiece for one month and checks the time in the same manner. For example, it is found that the watch is still one minute fast. After restoring the watch to the standard time, the user rotates the crown 3 by 1 big scale toward "–" scale to complete a second adjustment. In this way, the user can repetitively make adjustments to the watch. Finally, the error of the watch can be greatly reduced. Besides, the error of a mechanical movement is associated with environmental factors and individual habits. The compensation adjustment device according to the present invention enables individualized adjustments to the timepiece. Different users can adjust the timepiece freely according to their own conditions so as to achieve precise timekeeping.

In operation, it is also possible that the scale in the chapter ring 4 is not consistent with the predetermined value. For example one big scale on the chapter ring 4 is not corresponding to one minute. As a result, the user may find out that the watch becomes 5 minutes slow after the first adjustment. Then, the crown 3 can be rotated towards the opposite direction in the second adjustment, particularly, back to the middle between the initial position and the position after the first adjustment (i.e. 2.5 big scale towards "+"). Of course such problems will be minimized if the manufacturer sets the scale on the ring according to the characteristics of the balance spring 13.

It will be apparent to those skilled in the art that modifications and variations may be made in the compensation adjustment device of the present invention without departing from the spirit or scope of the invention. It is intended that the present invention covers all the modifications and variations thereof provided they come within the scope of the appended claims and their equivalents.

What is claimed is:

1. A compensation adjustment mechanism for a mechanical timepiece, comprising:

a gear set and a crown, a first gear at the input end of the gear set being connected to the crown, a second gear at the output end of the gear set being connected to a regulator pin on a balance spring, such that a position of the regulator pin can be adjusted by rotating the crown; and a chapter ring at least one of inside and outside a surface of the timepiece, the chapter ring being connected to the gear set via an additional gear set such that the chapter ring rotates with the crown, wherein a scale on the chapter ring is predetermined according to characteristics of the balance spring.

2. The compensation adjustment mechanism according to claim 1, wherein the regulator pin is provided with a rack, the rack being engaged with the second gear such that a rotation of the second gear drives the movement of the rack which in turn adjusts the regulator pin.

3. The compensation adjustment mechanism according to claim 1, wherein the regulator pin is fixedly connected to a gear coaxial with a shaft for holding hands of the timepiece, the coaxial gear engages with the second gear.

4. The compensation adjustment mechanism according to claim 1, wherein the gear set is configured to magnify the movement of the regulator pin by about 20 times to about 40 times.

5. The compensation adjustment mechanism according to claim 1, wherein a scale on the chapter ring is uniformly spaced.

6. The compensation adjustment mechanism according to claim 1, wherein a scale on the chapter ring is non-uniformly spaced.

7. The compensation adjustment mechanism according to claim 1, further comprising a clutch between the first gear and the crown.

8. A mechanical timepiece having a compensation adjustment mechanism according to claim 1.

9. A compensation adjustment mechanism for a mechanical timepiece, comprising:

a gear set and a crown, a first gear at the input end of the gear set being connected to the crown, a second gear at the output end of the gear set being connected to a regulator pin on a balance spring, such that a position of the regulator pin can be adjusted by rotating the crown; and a chapter ring at least one of inside and outside a surface of the timepiece, the chapter ring being connected to the gear set via an additional gear set such that the chapter ring rotates with the crown, wherein a scale on the chapter ring is uniformly spaced.

10. A compensation adjustment mechanism for a mechanical timepiece, comprising:

a gear set and a crown, a first gear at the input end of the gear set being connected to the crown, a second gear at the output end of the gear set being connected to a regulator pin on a balance spring, such that a position of the regulator pin can be adjusted by rotating the crown; and a chapter ring at least one of inside and outside a surface of the timepiece, the chapter ring being connected to the gear set via an additional set such that the chapter ring rotated with the crown, wherein a scale on the chapter ring is non-uniformly spaced.

* * * * *